US005277007A

United States Patent [19]

Hellwig et al.

[11] Patent Number: 5,277,007

[45] Date of Patent: Jan. 11, 1994

[54] OFFICE PANEL WITH TOP LAY-IN PASSAGEWAY

[75] Inventors: John Hellwig, Toronto; Ian B. Kuznick, Bolton, both of Canada

[73] Assignee: Teknion Furniture Systems, Downsview, Canada

[21] Appl. No.: 878,432

[22] Filed: May 4, 1992

[51] Int. Cl.[5] ..... E04B 2/74

[52] U.S. Cl. ..... 52/220.7; 174/48

[58] Field of Search ..... 52/221, 220, 239, 127.12, 52/220.7; 174/48, 49

[56] References Cited

U.S. PATENT DOCUMENTS

| | | | |
|---|---|---|---|
| 2,766,855 | 10/1956 | Johnson et al. | 52/127.12 |
| 3,471,629 | 10/1969 | O'Leary | 174/49 |
| 4,255,610 | 3/1981 | Textoris | 174/48 |
| 4,535,577 | 8/1985 | Tenser et al. | 52/221 |
| 4,874,322 | 10/1989 | Dola et al. | 52/239 |
| 4,891,922 | 1/1990 | Hozer et al. | 160/135 |
| 5,155,955 | 10/1992 | Ball et al. | 52/241 |

*Primary Examiner*—James L. Ridgill, Jr.

[57] ABSTRACT

The present invention relates to improvements in office panelling systems and the distribution of wires therethrough. A specialty lay-in wire is stackable above other panels and has an open channel for receiving wires, cables and the like without threading through the panels.

7 Claims, 4 Drawing Sheets

OFFICE PANEL WITH TOP LAY-IN PASSAGEWAY

FIELD OF THE INVENTION

The present application is directed to office panelling systems and in particular, to office panelling systems capable of easily accommodating installation of feed cables, wires and the like through the panelling system. In an aspect of the invention, the office panelling system is adapted to have lay-in wire panels stacked atop other panels, with these lay-in wire panels defining an open passageway for receiving cables and wires.

BACKGROUND OF THE INVENTION

A number of systems have been designed for allowing subdividing of office space and the convenient capability to provide power and communication capability at work stations.

One such system is shown in our U.S. Pat. No. 4,535,577 where power is provided at desk height by means of an access door with the panel including an electrical power conduit or passageway through the panel, preferably directly below the access door. Because communication cables are not particularly compatible with power cables, a separate communication passageway is provided therebelow.

Other arrangements have provided an access arrangement at the base of the panel into which the cable feeds can be placed. A further system provides a beam type arrangement at desk height and this beam is capable of receiving electrical power and communication cables.

All of these systems can be installed to satisfactorily provide power to a work station and to distribute communication cables to the various work stations. With the advances made in technology, it is now often desirable or necessary to go back to an existing panelling system and install communication cables and the like. In many cases, these will be low voltage cables which do not require an electrical conduit, or if they are electrical power cables, they can be shielded cables, and a difficulty arises in threading of the cables through various ports in the office panels. Some panels include passageways at the lower edge of the panel which are open to the side, however, in these cases, other equipment such as desks, tables, machinery, etc. may be in front of the panel, rendering access to this lower conduit difficult. Even access above desk height to a passageway may be difficult due to machinery, etc. on the working surfaces. Any arrangement requiring threading of the cables through the system is quite labour intensive and normally requires direct access to the interior of the panel.

There remains a need to provide a system and method for allowing the retrofit of a cabling system with communication cables and the like in a convenient manner.

SUMMARY OF THE INVENTION

A lay-in wire panel is used in an office panelling system, according to the present invention, and this lay-in wire panel has opposed side frames and a bottom frame with a cable receiving channel open on one surface of the frames of the panel and at the ends thereof. The cable receiving channel receives by having placed therein cables, wires and the like between the opposed side frames with the cables, wires and the like entering and exiting the panel through the open ends of the channel. With this arrangement, cables, wires and the like may be placed in the panel without threading of the cables through access ports of the office panelling system.

According to an aspect of the invention, the lay-in wire panel is stackable on other panels and is placed at the upper edge of the office panelling system. The lay-in wire panel is a specialty panel specifically adapted for this purpose.

According to yet a further aspect of the invention, the lay-in wire panel is less than 12 inches in height and is preferably approximately 6 inches in height.

According to yet a further aspect of the invention, the office panelling system is of variable height and the lay-in wire panels are atop each of the panels and various arrangements are provided for transitions in height between one section of the office panelling system and an adjacent section of the panelling system at a lower height.

With the arrangements as outlined above, an existing office panelling system may be used to receive and support the specialty lay-in wire panels during a retrofit application where additional communication cables or the like are to be added. The upper edge of the panel is normally fully available and easily accessible, thereby making the transition convenient and easy. The lay-in wire panels are merely stacked above the existing panelling system at the upper edge to provide a raceway or passageway along the upper edge and various transition members are provided for changes in height of the panels.

The lay-in wire panel, which is a specialty panel of only minimum height, allows for convenient retrofit of existing systems. This specialty panel can also include a panel having a lower portion which does not receive cables with the open channel located above the lower portion.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
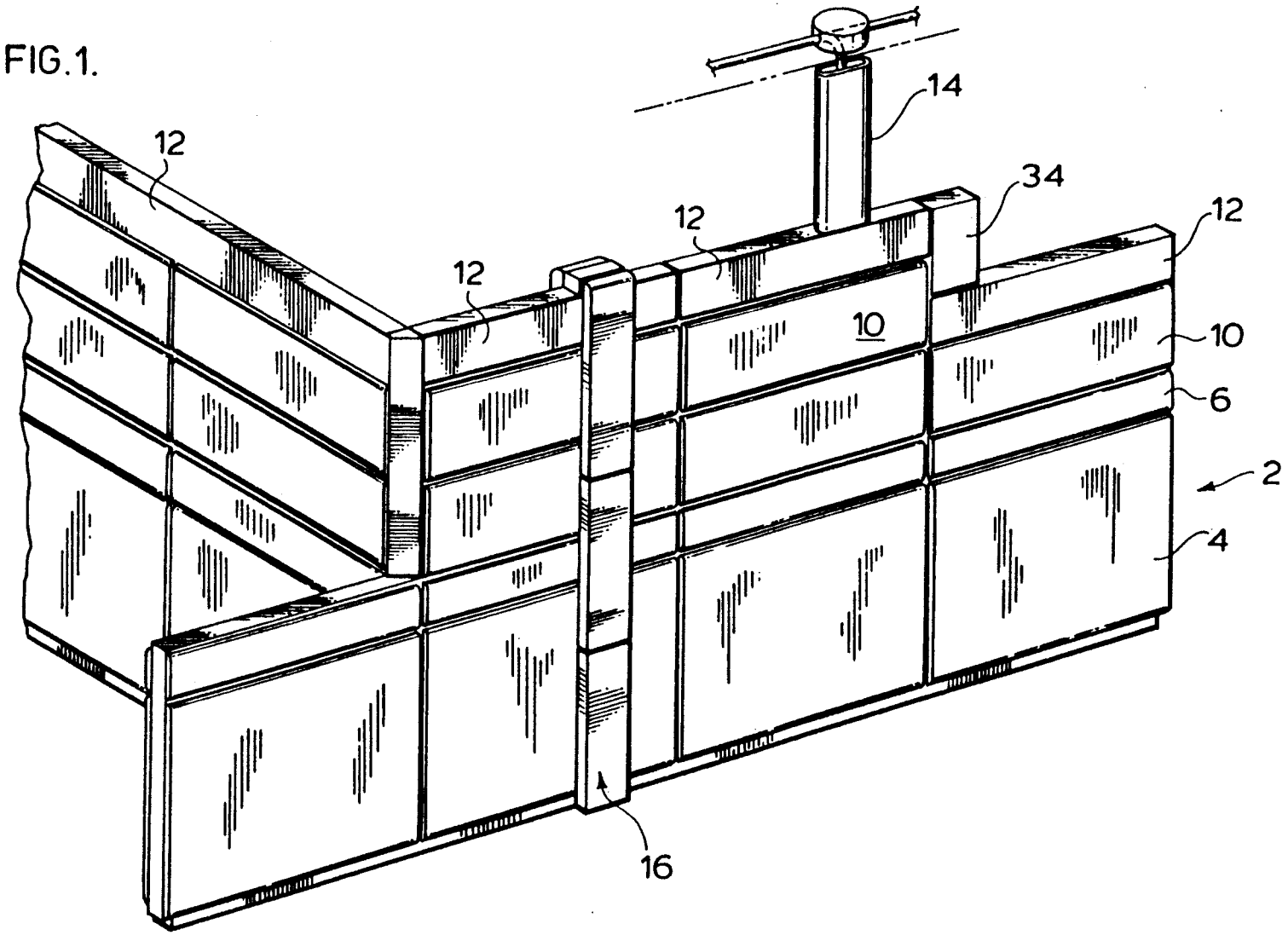
FIG. 1 is a partial perspective view showing a portion of an office panelling system having the lay-in wire panel stacked thereabove.
Figure 2:
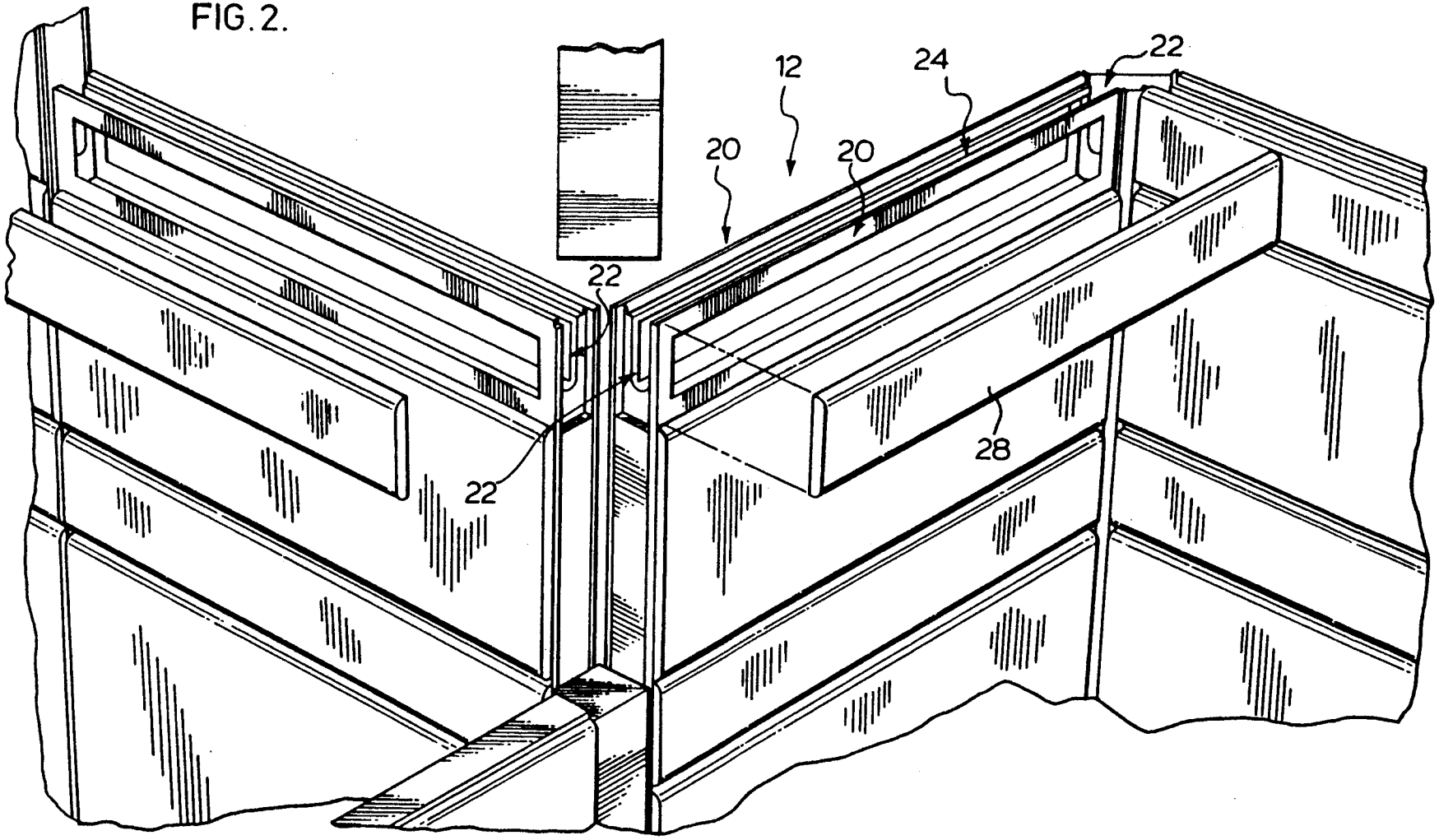
FIG. 2 is a partial perspective view showing the frames of the lay-in wire panel stacked above existing panelling systems.

The office panelling system 2 is generally of the type shown in our U.S. Pat. Nos. 4,535,577 and 4,881,349. This panelling system is based on a frame to which decorative elements and/or functional elements may be placed. In the system, a lower decorative element 4, an access door 6 and upper decorative elements 10 are provided. Lay-in wire panels 12 are stacked above the lower panels, which lower combination may be a single panel or stacked panels. The lay-in wire panel 12 is of reduced height and is specialized for this capability of conveniently receiving wires, cables and the like in an installed system. The lay-in wire panels are preferably always at the top of the office panelling system. A top drop-down feed 14 is shown and a bottom feed arrangement 16 is shown for allowing wires, cables and the like to gain access to the lay-in wire panel 12. As can be appreciated from the Figure, these lay-in wire panels 12 at the upper edge of the office panelling system define an open passageway into which cables, wires and the like may be placed and/or removed, and as such, is extremely convenient for retrofit applications which do not require threading of the cables through each of the panels. It is also convenient from the point of view that an existing system may be retrofitted merely by the addition of these lay-in wire panels and, thus, easily accommodate a retrofit requiring the distribution of additional wires and cables.

The lay-in wire panels 12 each comprise opposed rectangular side frames 20 and slotted end frames 22. An open top channel 24 is shown which receives the cables and the like. The channel is generally "U" shaped and open at the end panel frames 22, thereby allowing the lay-in of wires without the threading of wires through ports in the end frames. Decorative elements 28 may be used to close the rectangular side frames 20. Once cables, wires and the like have been placed in the channel 24, a closing member 32 may conceal the passageway until it is necessary to again gain access thereto. Stacking members 40 project from the lower surface of the lay-in wires panels 12 and engage aligned vertical members of the panel therebelow. The lay-in wires panels 12 are preferably directly stacked above panels of similar horizontal extent, although it would be possible to have lay-in wire panels traversing two such panels, if it was deemed necessary. By maintaining the vertical alignment of the panels, full flexibility with respect to relayout of the panels is achieved, as each panel will have its own lay-in wire panel associated therewith.

The stacking member 40 includes a key slot 42 used with the clamping of one panel to an adjacent panel, as taught in our U.S. Pat. No. 4,881,349, and access port 44 has also been provided in the stacking member to align with similar ports in the ends of the conventional panels which will support the lay-in wire panels.

Figure 3:
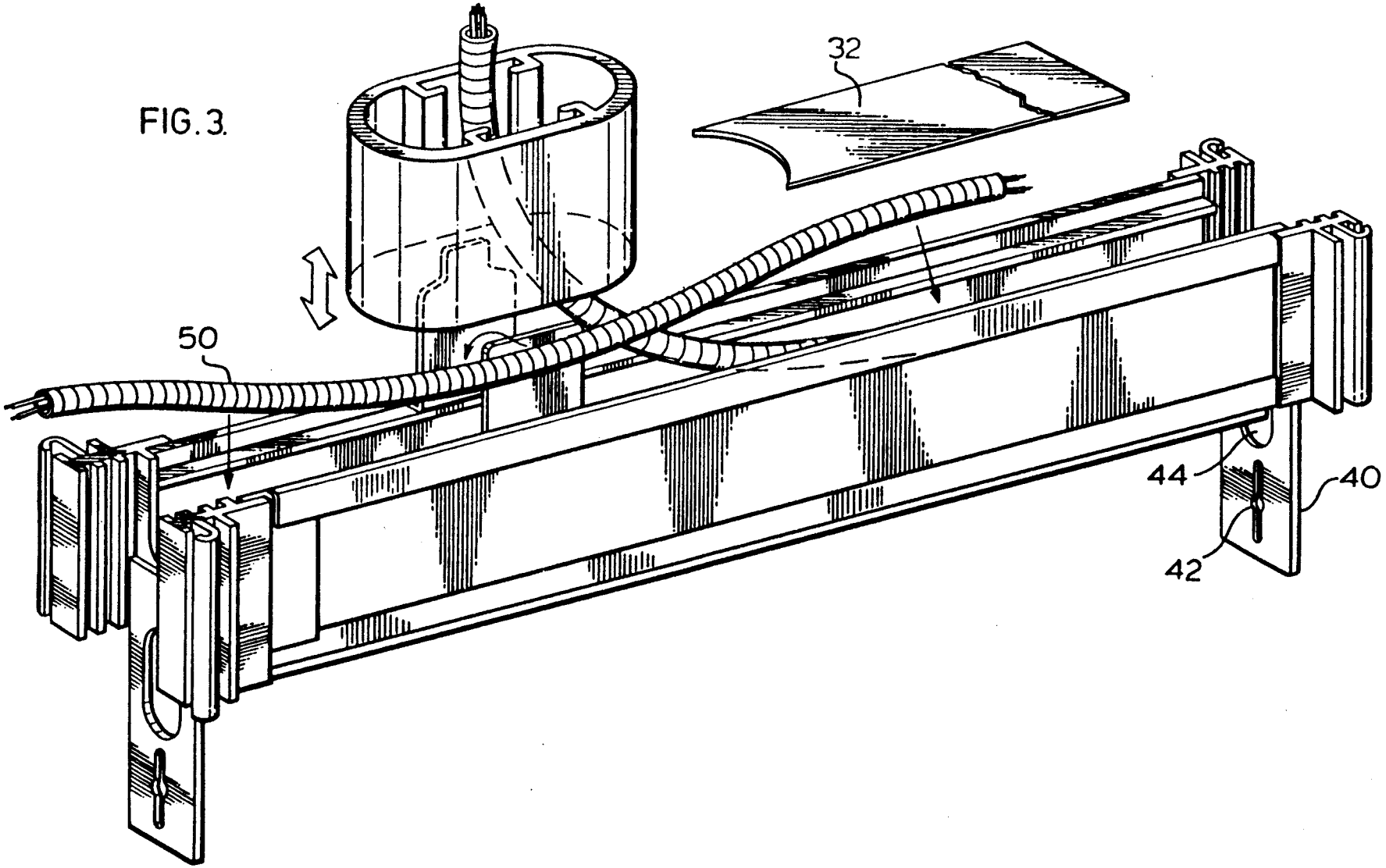
FIG. 3 is a perspective view of the frame of a lay-in wire panel system illustrating the channel thereof.
Figure 4:
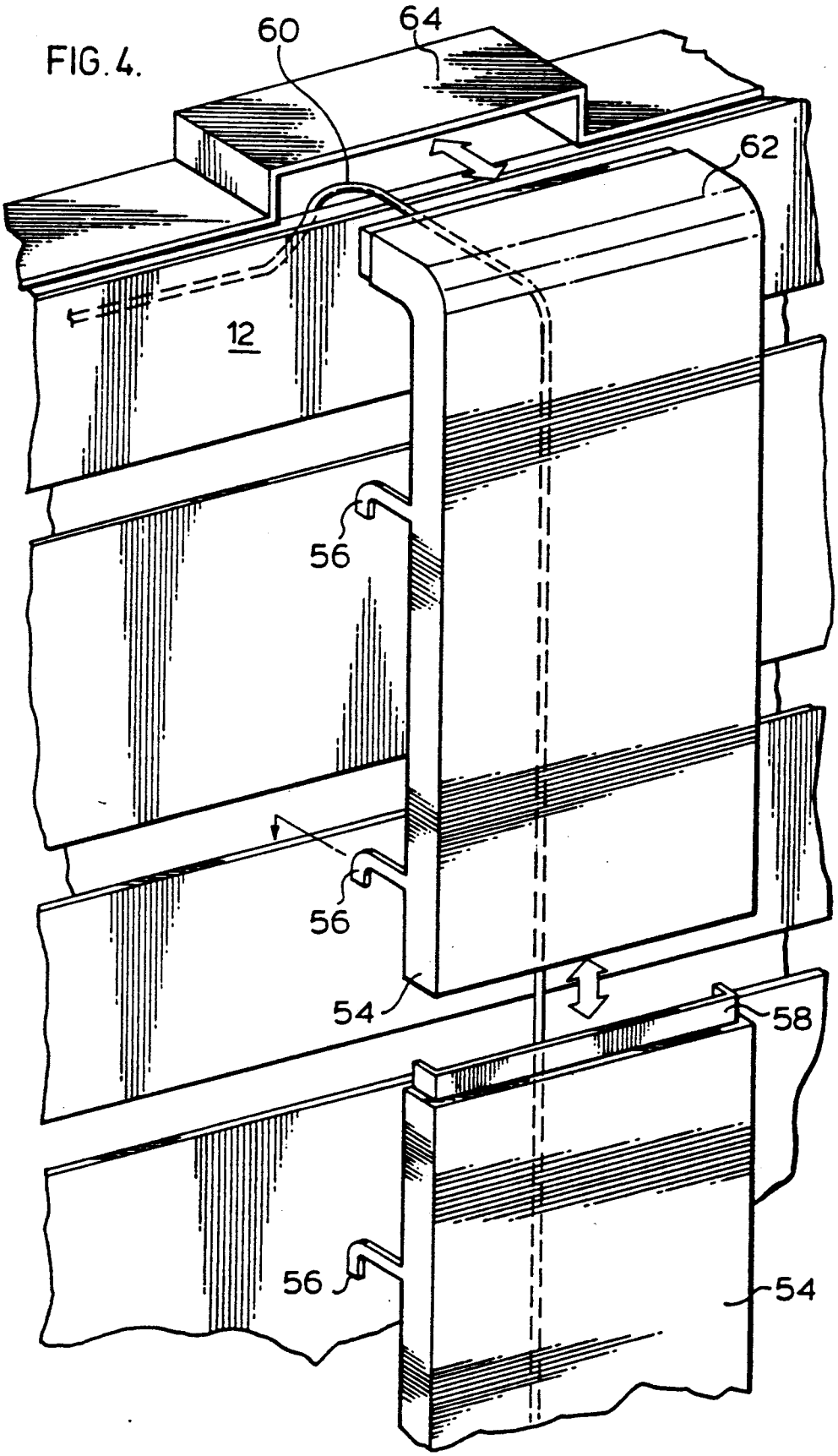
FIG. 4 is a partial perspective view showing one arrangement for providing a bottom feed to the lay-in wire panel.

In FIGS. 3 and 4, it is shown that cables 50, which can be optical communication wires and cables, can be dropped into the passageway defined by the channel 24 and, thus, a top raceway is provided through the system, where required, merely by the provision of the lay-in wires panels. As shown in FIG. 1, there is a requirement with this type of system to allow for vertical transitions. In this case, a special vertical drop 34 is provided which allows for joining of the highest lay-in panel 12 of FIG. 1 with a lower lay-in panel 12 to the right side of FIG. 1.

As can be appreciated from FIG. 1, a top raceway has been provided to a number of panels of FIG. 1 and these raceways or passageways can be used for providing power at desk height. There can be a number of ports within the channel to allow feeding of cables down to desk height, traditionally at the level of the lower edge of the access door 6. Thus, wires can be threaded down through the panels to the work surface, gaining access through the access door 6 to the work surface. This is possible, as the interior frame of the panels have both horizontal and vertical ports in the various members to allow cables to pass in any direction therethrough.

In FIG. 4, it can be seen that the optical wire 60 is within the "U" shaped channel of the lay-in panel 12 and passes through an access arrangement 64 in the closing member 32 to gain access to the transition shoot 62 of the protecting covers 54. The protecting covers are typically of a channel section and merely cooperate with the panel to protect the cables as they pass over the surface of the panel. In this way, you do not have to gain access to the interior of the panel and can merely put the cables in place in the lay-in panels 12 and in a vertical section on the exterior of the panels. Although this has been shown intermediate a panel, the vertical transition arrangement could be provided at the junction between panels.

The protecting covers 54 engage horizontal channels extending across the frame which are accessible at horizontal edges of the decorative elements of the system. Thus, the panel engaging hooks 56 may engage the frame of the panelling system and be secured thereto. As with other office accessories, the hooks are placed in the gaps and then moved downwardly to have the hook 56 engage the actual slot.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In combination a plurality of office panels which cooperate to form a partition for subdividing an area, said panels being of at least a first type panel and a second type panel, each first type panel having a frame and cooperating with stacking means for stacking either a first type or a second type panel in line with and atop the first type panel, said second type panels being stacked above said first type panels and held in stacked relationship by said stacking means; said stacking means providing a structural connection between each first type panel or each second type panel stacked above and in line with a first type panel immediately therebelow; said second type panels cooperating to define a top open conduit for said partition interior to said second type panels; each second type panel comprising opposed sides frames interconnected by a bottom frame and open on the top thereby defining a portion of said top open conduit which is open at an upper edge between said side frames and open at opposite ends of the second type panel; said second type panels which are positioned in an end to end horizontal type relationship collectively defining at least a horizontal segment of said top open conduit at an upper surface of said partition; said combination further including releasable top cover members which close said top open conduit.

2. In combination as claimed in claim 1 wherein said second type panels are of a height less than 12 inches.

3. In combination as claimed in claim 1 wherein sides of each panel type have secured thereto decorative cover members.

4. In combination as claimed in claim 1 wherein said stacking means includes extension members which cooperate with end faces of stacked panels and provide a structural connection therebetween.

5. In combination as claimed in claim 4 including a cable chute to the exterior of the partition and on one side thereof and connecting with said top open conduit, said cable chute accommodating cables and providing a vertical transition for cables to access said top open conduit.

6. In combination as claimed in claim 1 wherein said partition is of different heights and a drop transition module is provided between adjacent second type panels at different heights, each drop transition module having opposed ports separated by a hollow passageway, each port communicating with one top open conduit of said adjacent second type panels to define a cable receiving conduit between said adjacent second type panels.

7. In combination as claimed in claim 6 wherein said ports of each drop transition module are a side port at an upper second type panel and an end port at a lower second type panel.

* * * * *